United States Patent [19]

Lefebvre

[11] 4,040,353

[45] Aug. 9, 1977

[54] PROCESS FOR COLORING SURFACES

[75] Inventor: Michel Serge Lefebvre, Guise, France

[73] Assignee: OPI Metriservice, Societe Anonyme, France

[21] Appl. No.: 626,317

[22] Filed: Oct. 28, 1975

[30] Foreign Application Priority Data

Oct. 31, 1974 France ..... 74.36399

[51] Int. Cl.[2] ..... B41M 5/14; G09F 19/14

[52] U.S. Cl. ..... 101/426; 35/9 H; 40/137; 101/211; 283/6; 356/71

[58] Field of Search ..... 351/30, 32, 35; 356/71; 40/137; 35/9 H, 28.3; 283/6; 101/211, 426

[56] References Cited

U.S. PATENT DOCUMENTS

| | | | |
|---|---|---|---|
| 2,277,405 | 3/1942 | McKiernan | 101/211 |
| 2,385,992 | 10/1945 | Jobe | 351/32 |
| 2,937,567 | 5/1960 | Harry et al. | 351/35 |
| 3,103,880 | 9/1963 | Sanford et al. | 101/211 X |
| 3,147,699 | 9/1964 | Land | 101/211 |
| 3,256,770 | 6/1966 | Wicker | 356/150 |
| 3,381,612 | 5/1968 | Lecha | 101/401.1 X |
| 3,675,948 | 7/1972 | Wicker | 283/6 |
| 3,752,073 | 8/1973 | Lorber | 101/211 |

FOREIGN PATENT DOCUMENTS

| | | | |
|---|---|---|---|
| 230,361 | 3/1944 | Switzerland | 351/32 |

OTHER PUBLICATIONS

Pseudo-Isochromatic Plates for Testing Color Perception, Am. Optical Co., Copyright 1940.

*Primary Examiner*—John F. Pitrelli
*Assistant Examiner*—Paul J. Hirsch
*Attorney, Agent, or Firm*—Weingarten, Maxham & Schurgin

[57] ABSTRACT

The invention relates to a process for coloring surfaces in such a way that two juxtaposed colored areas cannot be visually perceived as distinct from one another unless their distance from the eye drops below a predetermined distance. The first area is colored by juxtapositioning unitary zones of at least two colors and the second area is colored by the resultant color of the optical mixture of the colors used for the first area. One important application of the invention is in display advertising.

5 Claims, 1 Drawing Figure

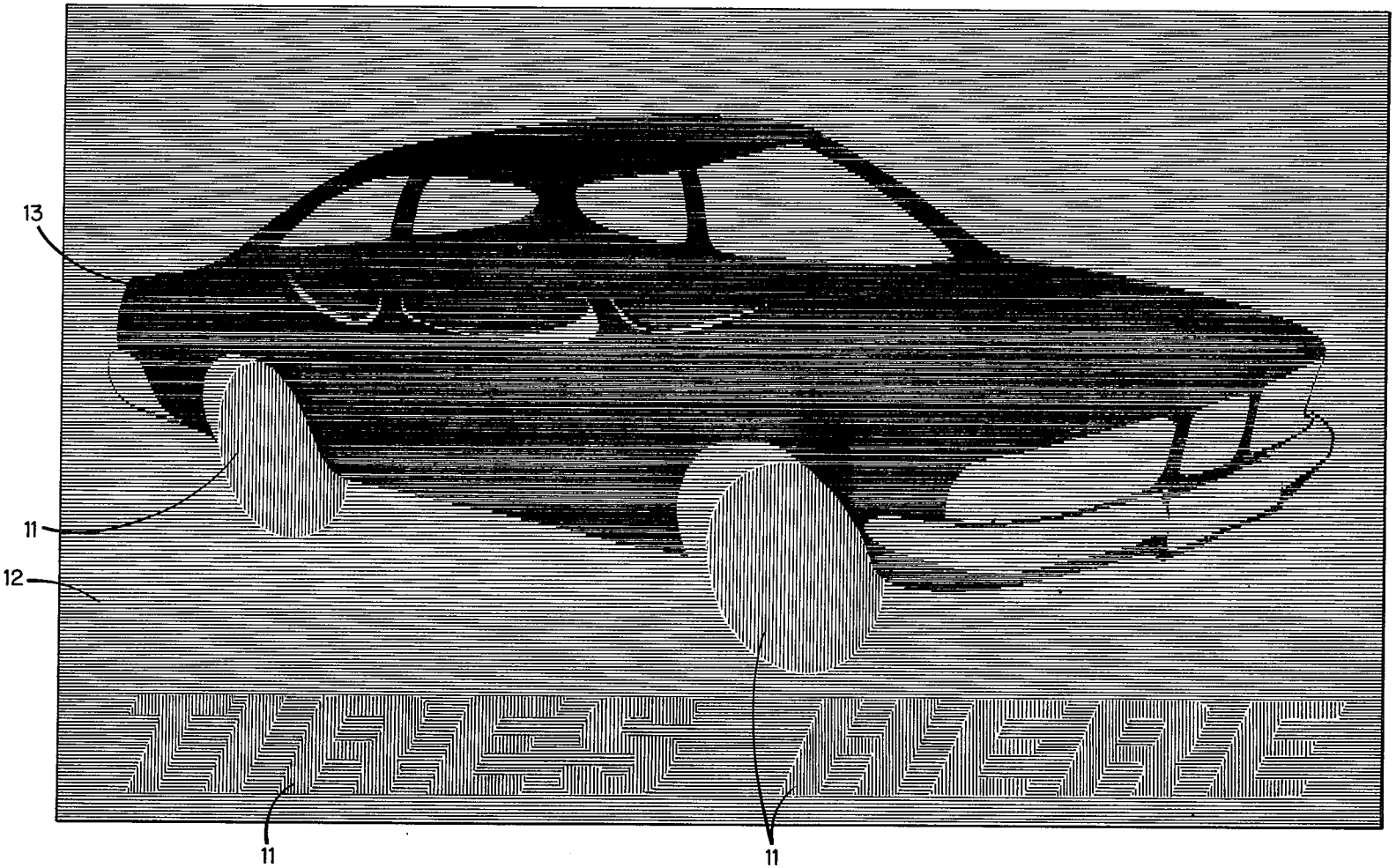
11
11
11
12
13

PROCESS FOR COLORING SURFACES

The present invention relates to the colouring of surfaces and can be used in different fields, such as advertising, decoration, clothing, etc.

The dot printing principle has long been known, which uses the property of the human eye called the resolving power. Beyond a certain distance the eye is no longer able to distinguish two separate points and only sees a single blob. This distance is a function of the dimensions of the points, the distance between them and the characteristics of the eye, and corresponds in fact to a particular angle of the field of vision. Dot printing utilises this property in that it colours a surface with juxtaposed dots rather than by a flat tint method where the colour is applied in uniform manner. The distance between the dots and their dimensions are selected in such a way that at the average distance for viewing this surface the eye only perceives a uniform surface. One of the important advantages of this printing method is the thus obtained economy on ink.

The integrating power of the eye is also known. When two colours A and B are mixed in a particular percentage, the eye is only able to distinguish a uniform colour C, which is characteristic of the base colours and the percentages used. This colour C can be called the resultant colour. Various methods can be used for obtaining this optical mixture of two colours A and B. Thus, the dots of each colour can be juxtaposed on a surface with an almost uniform distribution thereof, so that the eye then only distinguishes the resultant colour. The method whereby a succession of coloured areas is employed, wherein areas of different colours are passed in front of the eye alternately and at high speed also leads to the perception of only the resultant colour. It is obviously possible to use, in the same way, a larger number of base colours.

Through combining the dot printing method and the principle of resultant colours the present invention has for its object a novel colouring process for surfaces, as a result of which two juxtaposed coloured areas can only be visually distinguished from one another when the distance thereof from the eye falls below a predetermined distance.

To this end the first area 11 is coloured by juxtapositioning unitary zones of at least two colours, whereby these zones are distributed in a substantially uniform manner on the first area, whereby the average surface area of each of these unitary zones is defined according to the predetermined distance below which the two areas are distinguished by the eye, whereby the sum of the surface areas of the unitary zones of each colour corresponds to a clearly defined percentage of the total surface area of the said first area, and whereby the second area 12 is coloured by the resultant colour of the optical mixture in the percentages defined for the first area of the colours used for the said first area.

Preferably this second area is uniformly coloured by a single colour. This single colour is the resultant colour of the optical mixture of the colours used in the first area. It is preferably determined by the method of succession of the coloured areas, permitting the materialisation of a resultant colour. However, the colouring of this second area can also be obtained by juxtapositioning unitary zones in the same colours and the same percentages as the first area. In this case the average surface area of each of the unitary zones of the second area must be less than the average surface area of each of these unitary zones of the first area. Still another coloured area 13 depicts printed words and the silhouette of an automobile. The particular colour of area 13 and the fact that it appears in the drawing is not germane to this invention.

It is to be understood that on the first area coloured by the dot printed method, the unitary zones cannot be distinguished from one another by an eye located beyond a minimum distance which is called the perception distance. This perception distance is determined by the average surface area of each zone and the characteristics of the eye. When located beyond this distance, the eye sees a single coloured area in the form of the resultant colour as has been defined hereinbefore.

The zones can have a random regular or irregular form. However, dots are the preferred form because they are the easiest to produce. It is, for example, possible to use blue dots and red dots. There are then two base colours, each occupying a clearly defined percentage of the total surface area. The distribution of the zones of each colour must be substantially uniform so that the eye positioned beyond the perception distance sees only a single resultant colour and not zones of different colours (base colour, or partial resultant colours).

The second area, juxtaposed with the first, is coloured with the resultant colour of the base colours of the first surface area, so that the eye perceives it this way, no matter what distance it is located therefrom.

Thus, when placed beyond the perception distance the eye perceives the first and second areas in the same way. As these areas are juxtaposed they appear to be optically blended. However, when positioned at a distance below the perception distance these two areas would appear quite distinct from one another, whereby the first would have juxtaposed zones of different colours, and the second only one colour.

To colour the second area with a resultant colour, this resultant colour can be determined and applied in uniform manner to the second area, e.g. by a flat tint method. In the above example mauve would be used corresponding to the optical mixture of red and blue. It is important that the determination of the resultant colour is very precise and the use of the device called a colour integrater, described in French Pat. No. 1,554,843 is particularly advantageous. Based on the method of succession of coloured areas and more precisely on the principle of colour mixtures by rotation, it permits the driving at high speed of a disc formed by more or less open segments of different colours. Thus, the eye preceives a single colour which is the resultant colour of the optical mixture of the colours of the segments, in accordance with a percentage which is proportional to the opening of the corresponding segments.

This second area can also be coloured by juxtapositioning zones in the same colours and in the same percentage as the first area. Unitary zones are used whose average surface area is smaller than the average surface area of the unitary zones of the first area. The perception distance corresponding to this second area is therefore smaller than that of the first area. Thus, this second area will be perceived with an optically uniform colour when the first area becomes distinct. According to the application of the invention the perception distance permitted for the second area is determined and from this is deduced the average surface area which must be given to each unitary zone of the said second area.

To some extent the process according to the invention makes it possible to render a surface invisible for an eye located beyond a predetermined distance and render it visible when the eye approaches it from a distance below the perception distance. It can be numerous applications: dissimulation of unaesthetic inscriptions or surfaces, decoration, clothing (printing textiles which appear differently depending on the distance from which they are viewed).

By varying the characteristics of the first area, i.e. the average surface areas of the unitary zones, different perception distances are determined. Thus, an eye moving toward a base surface will successively perceive several areas arranged on this base surface or even overlapping or "nested" within one another. When the second area, which serves as the base surface is also coloured by zonal juxtapositioning it becomes possible to combine all the characteristics of the two areas to obtain very varied effects. In this latter case it becomes possible to use only black and white.

One important application is in the field of display advertising. The surface of the letters forming an advertising text is printed according to the colouring method defined hereinbefore for the first area. The support on which these letters are placed is coloured according to the method for the second area. Thus, for a person viewing the hoarding on which the text is "written" the said text only becomes perceptible and legible when he is located at a distance below the perception distance defined according to the invention. These letters can obviously be supplemented or replaced by drawings. It is possible in this way to produce advertisement hoardings alongside highways, in pedestrian passageways, etc. In this way it is also possible to produce a display advertisement so that different information is transmitted to persons located at different distances therefrom.

By means of such a method it is possible to obtain a new type of "watermark", whereby the design to be reproduced is printed on the paper according to the process of the present invention. It only becomes visible at less than a distance which is made small.

In this way characteristic patterns can be printed which would be difficult to reproduce and which could therefore be used for checking purposes, e.g. on banknotes or cheques.

What is claimed is:

1. A process for preparing a coloured surface having different visual impressions depending upon the distance from which it is viewed, said process comprising the steps of:

colouring a first area of said surface by at least two colours in the following manner:

distributing distinct first unitary zones of a first color substantially uniformly over predetermined portions of said first area of said surface;

distributing distinct second unitary zones of a second colour substantially uniformly over predetermined portions of said first area of said surface, whereby the sum of the surface areas covered by said unitary zones of said first colour bears a predetermined ratio relationship with respect to the sum of the surface areas covered by said unitary zones of said second colour, said unitary zones of each of said at least two colours being of such size that they are not visually distinguishable when viewed from beyond a predetermined distance at which said surface is clearly visible;

determining the resultant colour of said at least two colours in said first area, said resultant colour being the optical mixtures of said at least two colours in the ratio of surface areas covered by each colour in said first area; and colouring a second area of said surface with said resultant colour, said first and second areas being juxtaposed;

whereby when viewed from beyond said predetermined distance, said first and second areas are distinguishable while said surface is clearly visible, and when viewed from a point located at a distance equal to or less than said predetermined distance, said first area is perceived as having juxtaposed zones of said at least two colours and said second area is perceived as having said resultant colour.

2. A process according to claim 1, wherein the resultant colour is determined by the method of succession of coloured areas.

3. A process according to claim 1, wherein the second area is coloured by a juxtapositioning of zones in the same colours and in the same percentages as the first area, whereby the average surface area of each of these unitary zones of the second area is less than the average surface area of each of these unitary zones of the first area.

4. The process recited in claim 1 and comprising the further step of:

distributing distinct third unitary zones of a third colour substantially uniformly over predetermined portions of said first area of said surface, whereby the sum of the surface areas covered by each of said unitary zones of said first, second and third colours bears a predetermined ratio relationship with respect to the sum of the surface areas covered by each of the other unitary zones of the other colours, said first, second and third unitary zones each being of such size that they are not visually distinguishable when viewed from beyond said predetermined distance.

5. A coloured surface having different visual impressions depending upon the distance from which it is viewed, said coloured surface comprising:

a first area of said surface having juxtaposed zones of at least two colours distributed in a substantially uniform manner in said first area, said first area thereby comprising:

a multiplicity of unitary zones of a first colour distributed uniformly throughout said first area; and a multiplicity of unitary zones of a second colour distributed uniformly throughout said first area, the sum of the surface areas covered by said unitary zones of said first colour bearing a predetermined ratio with respect to the sum of the surface areas covered by said unitary zones of said second colour, said unitary zones of each of said first and second colours being of such size that they are not visually distinguishable when viewed from beyond a predetermined distance at which said surface is clearly visible;

a second area of said surface in juxtaposition with said first area; and a third colour covering said second area, said third colour being the resultant colour of the optical mixture of said at least two colours in their predetermined ratio in said first area;

whereby when viewed from beyond said predetermined distance said first and second areas are indistinguishable while said surface is clearly visible, and when viewed from a point located at a distance equal to or less than said predetermined distance said first area is preceived as having juxtaposed zones of said at least two colours and said second area is perceived as having said resultant colour.

* * * * *